United States Patent [19]

Niskin

[11] 4,417,718

[45] Nov. 29, 1983

[54] COUNTER BALANCED SHEAVE ASSEMBLY WITH MULTIPLE PULLEYS

[76] Inventor: Shale J. Niskin, 3415 Chase Ave., Miami Beach, Fla. 33140

[21] Appl. No.: 313,758

[22] Filed: Oct. 22, 1981

Related U.S. Application Data

[63] Continuation-in-part of Ser. No. 222,970, Jan. 7, 1981, Pat. No. 4,301,995.

[51] Int. Cl.[3] ..... B66D 1/36

[52] U.S. Cl. ..... 254/394; 254/415

[58] Field of Search ..... 254/394–406, 254/409–413, 415–416, 390, 392, 335–336, 284–285

[56] References Cited

U.S. PATENT DOCUMENTS

| | | | |
|---|---|---|---|
| 1,348,691 | 8/1920 | Beaumont | 254/415 |
| 1,351,469 | 8/1920 | Coleman | 254/415 |
| 1,968,321 | 7/1934 | Shope | 254/396 |
| 3,042,374 | 7/1962 | Livingston | 254/394 X |
| 3,132,844 | 5/1964 | Gatlin et al. | 254/394 |
| 3,207,477 | 9/1965 | Watt | 254/412 |

*Primary Examiner*—John M. Jillions

*Attorney, Agent, or Firm*—William A. Newton

[57] ABSTRACT

Disclosed is a counter-balanced sheave assembly for supporting a cable comprising a plurality of sheaves mounted in an arcuate path on a support frame; counter-balancing weights positioned above the support frame and rigidly connected thereto; and a suspension arrangement, connected at the center of the assembly, for providing rotation of the assembly about two perpendicular axes of rotation, whereby the cable stays within a plane defined by the arcuate path.

8 Claims, 7 Drawing Figures

COUNTER BALANCED SHEAVE ASSEMBLY WITH MULTIPLE PULLEYS

CROSS-REFERENCE TO RELATED APPLICATION

This application is a continuation-in-part of copending application, Ser. No. 222,970, filed Jan. 7, 1981; now U.S. Pat. No. 4,301,995.

BACKGROUND OF THE INVENTION

1. Field of the Invention

This invention relates to sheaves and is particularly directed to a sheave that is adapted to be suspended and having counter-balancing weights mounted above the sheave for maintaining the sheave in continuous alignment with a plane passing through the cable, and thereby avoiding improper wear of the rope and inefficient operation of the sheave.

2. Description of the Prior Art

At present, for such activities for lowering wire cables to which sensors and instruments are attached, as in hydrographic work from ships, a freely suspended sheave is employed. However, when the wire cable is not in the vertical plane because of towing angle, the prior art sheaves are unable to correctly lie in the plane of the line, causing undue wear on the line and the sheave, and possibly causing the cable to jump off the sheave.

The sheave assembly in allowed, copending U.S. patent application Ser. No. 222,970, filed Jan. 7, 1981, is able to avoid the above indicated malfunctioning of the sheave and wire cable by mounting counter-balancing weights above the suspended sheave or pulley. U.S. patent application Ser. No. 222,970 has the same inventor as the herein described invention and is not prior art hereto, but is described herein to better understand the problems solved by the present invention. Although the sheave of U.S. patent application Ser. No. 222,970 works very well in many situations, the use of the counterbalance weights requires a sheave assembly having an overall length that approaches twice the length of the sheave itself. Particularly with large sheaves on ships, there is frequently insufficient space to mount such a sheave assembly. Additionally, with large sheave assemblies of the type described, their weight causes them to be difficult to mount and cumbersome to handle.

U.S. Pat. No. 1,348,691 to Beaumont, discloses a counter-balanced pulley arrangement that exists in the prior art.

U.S. patent application Ser. No. 222,970 to Niskin, now allowed, is incorporated herein by specific reference thereto and is not prior art hereto.

U.S. Pat. Nos. 3,172,642; 3,132,844; 3,042,374; and 3,032,320 disclose various multiple sheave arrangements of the prior art.

SUMMARY OF THE INVENTION

The present invention is directed toward a counter-balanced sheave assembly for supporting a downwardly extending cable having a tension applied thereto, comprising a support frame having a plurality of sheaves rotatably mounted thereto in a downwardly facing arcuate path, counter-balancing means positioned above the support frame, connecting means for rigidly interconnecting the counter-balancing means and the support frame, suspension means mounted to the connecting means for pivotally suspending the assembly for rotation about two perpendicular axis.

By virtue of the above structure, the plane containing the arcuate path, at all times, approximately passes through and lies parallel with the cable positioned over the sheaves. As compared to the prior art counter-balanced sheave assemblies having a single sheave, the multiple sheave arrangement of the present invention allows the centers of mass of both the support frame and the counter-balancing means to be substantially closer to the suspension means, thereby greatly reducing the overall length and size of the sheave assembly. This is turn allows the sheave assembly to be used in space limited areas, such as aboard ships. Additionally, the multiple sheave arrangement of the present invention allows for a reduction in weight, making handling and mounting easier.

BRIEF DESCRIPTION OF THE DRAWINGS

Further objects and advantages of the present invention will become apparent as the following description proceeds, taken in conjunction with the accompanying drawings in which.

DESCRIPTION OF THE PREFERRED EMBODIMENT

Figure 1:
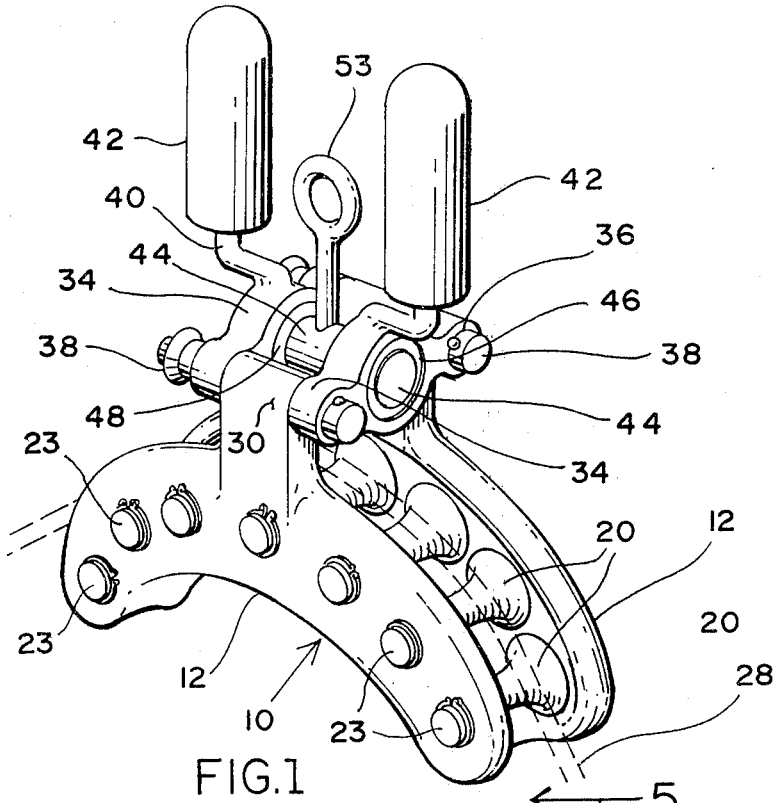
FIG. 1 shows a perspective view of the sheave assembly of the present invention.
Figure 2:
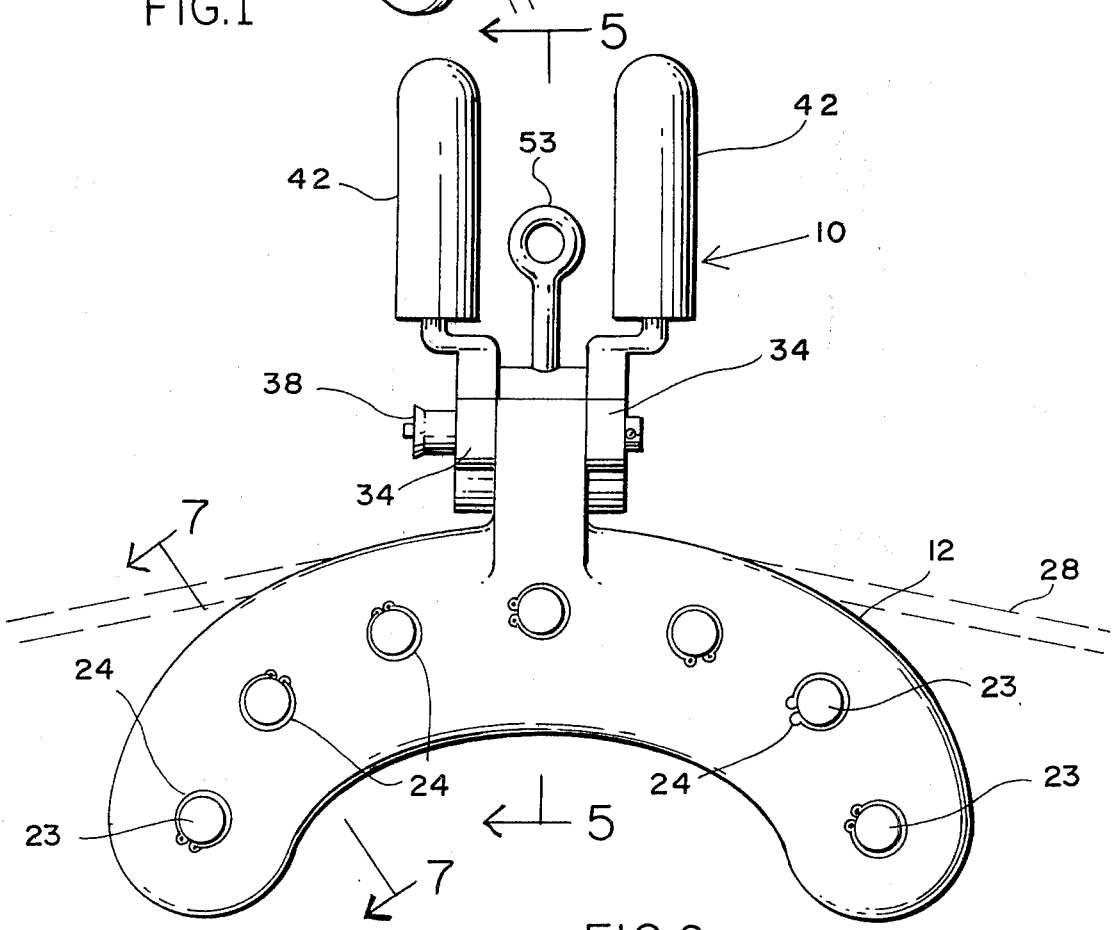
FIG. 2 shows a side view of the sheave assembly.
Figure 7:
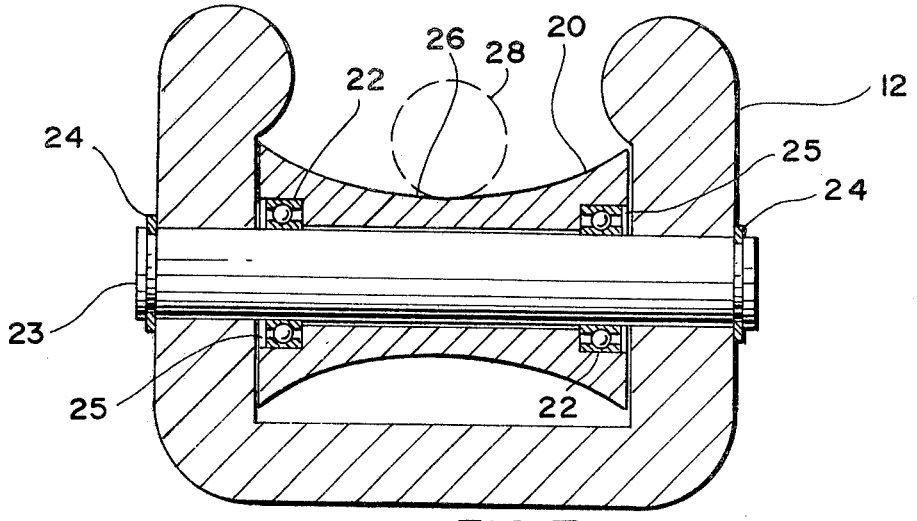
FIG. 7 shows a cross-sectional view of the sheave assembly taken along section line 7—7 in FIG. 2.
Figure 3:
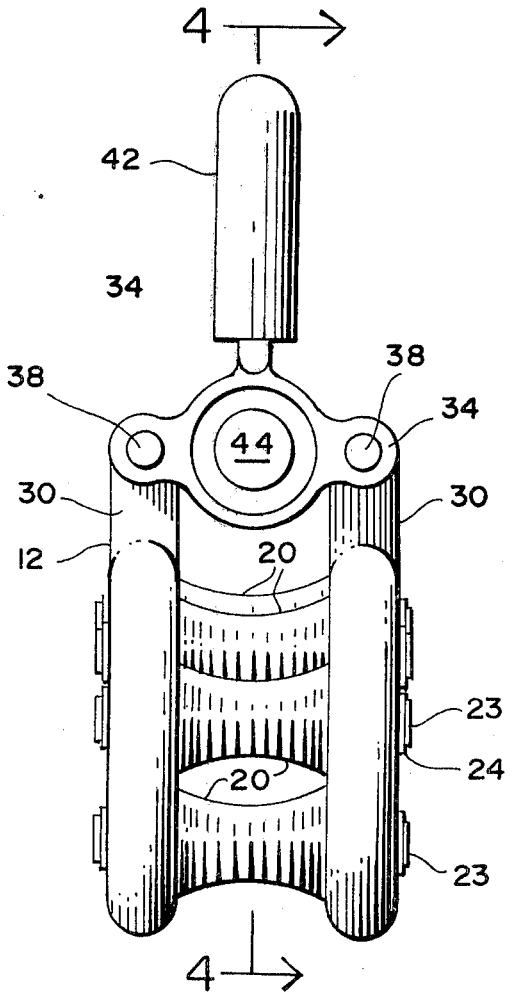
FIG. 3 shows an end view of the sheave assembly.
Figure 5:
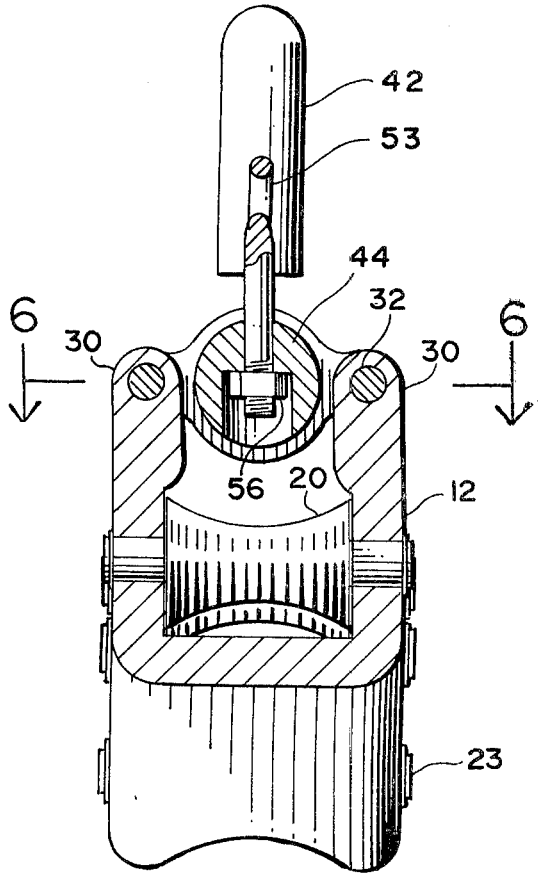
FIG. 5 shows a cross-sectional, end view of the sheave assembly taken along section line 5—5 in FIG. 2.
Figure 6:
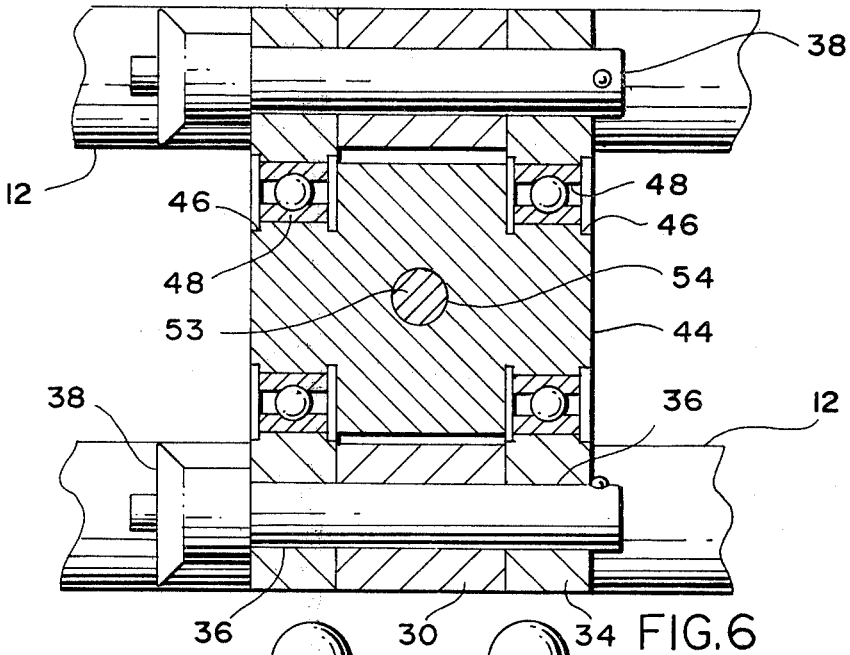
FIG. 6 shows a cross-sectional view of the sheave assembly taken along section line 6—6 in FIG. 5.
Figure 4:
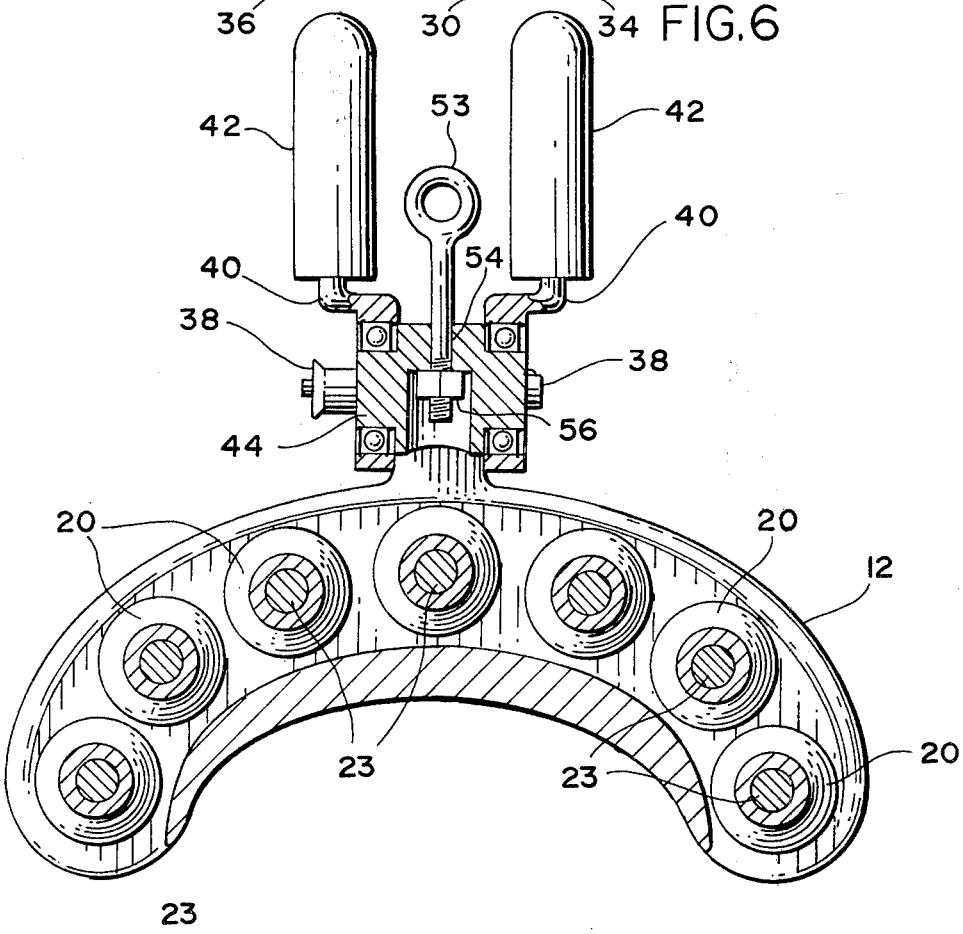
FIG. 4 shows a cross-sectional, side view of the sheave assembly taken along section line 4—4 in FIG. 3.

As shown in the FIGURES, there is disclosed a counter-balanced sheave assembly 10 constructed in accordance with the present invention. The assmebly 10 includes an arched support frame 12 defining an upwardly facing trough 14 with a U-shaped cross-sectional configuration.

Mounted inside the trough 14 is a plurality of sheaves or pulleys 20. Each sheave 20 comprises a steel ring 21 rotatably mounted on a ball bearing race 22, which in turn is mounted on an axle 23. Each axle 23 traverses the opposed sidewalls of the trough 14 and has its opposed ends extending beyond the sidewalls, so as to be lockingly engaged by a pair of arched retaining rings 24, on either side of the trough, for securing the axle 23 in place. The ball bearing race 22 is interposed between the periphery of the axle 23 and the steel ring 21 to provide relatively frictionless rotational movement. The steel ring 21 overlaps the ball bearing race 22 on both sides so as to allow a pair of rubber gaskets 25 to be positioned at the ends of the ball bearing race between the axle 23 and the steel ring 21. Each of the sheaves 20 are provided with an integrally formed, open groove 26 to receive a line, rope, cable or like cable element, hereinafter referred to as cable 28.

The sheaves 20 are aligned in a downwardly arcuate path or curve along the curved length of the trough 14, which generally, but not necessarily, conforms somewhat to the center of the trough 14. Preferably, although not necessarily, the arcuate path for alignment of the sheaves 20 has an increasing rate of curvature as the path extends outward and downward from its center. By virtue of this configuration, stress on the strands of the cables is equalized over the sheaves. The cable 28 is positioned over the sheaves 20, so as to fit in each of the grooves 26. The sidewalls of the frame 12 extend upward above the sheaves 20 so as to provide a guide for inserting the cable 28 and for maintaining the cable in place.

A pair of opposed mounting arms 30 are integrally formed on the sidewalls of the frame 12 at its upper, center portion and extend upward therefrom. Each mounting arm 30 has a pair of bore holes 32 formed therein, such holes being disposed in equally spaced relationship from a plane which bisects the trough 14 and the sheaves 20.

The remainder of the structure is the same as shown in incorporated U.S. patent application Ser. No. 222,970. Briefly described, connecting means are provided in the form of a pair of opposed side frames 34, each having a pair of bore holes 36 aligned with the bore holes 32. A pair of pins 38 pass through the holes 32 and 36 so as to rigidly couple the support frame 12 to the side frames 34. The connecting means further includes the side frames 34 having, respectively, a pair of upwardly extending, rigidly connected weight support arms 40. Rigidly mounted on top of the weight support arms 40 are counter-balancing means in the form of a pair of weight members 42, respectively. Consequently, the weights 42, weight support arms 40, the side frames 34 and the support frame 12 are all rigidly secured together.

Suspension means are provided for allowing pivotal motion about two axis, which are perpendicular to each other. The suspension means includes a first rotatable number, in the form of a swivel shaft 44, which is pivotally mounted between the lower ends of the side frames 34. By virtue of this pivotal connection, the connecting means which includes the side frames 34; the counter balancing weight members 42; and the support frame 12 with the sheaves 20 mounted thereto, all rotate as a single unit about the pivotal axis of the swivel shaft 44. The swivel shaft 44 is rotatably mounted in a pair of circular apertures 46, one of the pair being formed in each of the side frames 34 between and slightly above the holes 36. A ball bearing race 48 is positioned between each of the side frames 34 and the swivel shaft 44 to provide relative frictionless rotational movement of the shaft 44 about its pivot axis.

The suspension means further includes a second rotatable member, in the form of eyebolt 53, which extends through an opening 54 formed in the swivel shaft 44 and terminates in a counter-bored portion 55, where a nut 56 secures the eye bolt 53 against removal therefrom, but permits the rotation thereof. The axis of rotation of the eye bolt 53 is substantially perpendicular to the pivot axis of the swivel shaft 44. With light loads, the pivot axis of the eye bolt 53 will be at an angle with respect to the plane containing the arcuate path and the cable.

As described above, the suspension means are pivotally connected to the connecting means. However, this is only because the balance center (where the counter-balancing moments are equal) occurs there.

The arcuate path upon which the sheaves 20 are centered lies within a single plane, which approximately passes through the cable 28 at all times. Generally, this plane has at least a substantial vertical component. Each of the sheaves 20 have an axis of rotation which is the center axis of the axles 23. These axes of rotation are substantially perpendicular to the plane containing the arcuate path and the cable 28. The swivel shaft 44 has its pivotal axis parallel to the plane containing the arcuate path and perpendicular to the axes of rotation of the sheaves 20. Preferably, but not necessarily, this pivotal axis lies in the plane containing the arcuate path.

In normal use of the sheave assembly 10, it is suspended by the eye bolt 53 so that the cable 28, being payed over the plurality of sheaves 20, is above ground or platform level and extends downwardly from either end of the elevated frame 12. The frame 12 can swing in a horizontal plane about the axis of rotation of the eye bolt 53 and in a vertical plane about the axis of rotation of the swivel shaft 44; thereby automatically maintaining at all times the cable 28 in the plane of the arcuate path. As a result, the cable will by lying evenly in the groove 26 of each sheave 20.

As can be readily seen, the center of mass of the sheave 20 can be a substantially shorter distance from its pivotal mounting than that required by the single sheave design of incorporated application Ser. No. 222,970. Additionally, the total weight of the frame 12 and sheaves 20 is substantially less than that of the single sheave. The closer center of mass and less weight of the present invention allows the counter-balancing weights to be substantially lighter and/or shorter in length. The more compact design of the sheave assembly 10 readily allows the same to be used in space limited situations, such as exists on ships. The lighter weight of the sheave assembly allows for easier mounting and handling of the assembly.

Although particular embodiments of the invention have been shown and described here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. A counter-balanced sheave assembly for supporting a downward extending cable having a tension applied thereto, comprising:

a support frame;

a plurality of sheaves rotatably mounted to said support frame along a downwardly facing, arcuate path with their axis of rotation being substantially perpendicular to a plane containing said arcuate path;

counter-balancing means positioned above said support frame;

connecting means disposed between said counter-balancing means and said support frame for rigidly interconnecting the same;

suspension means pivotally connected to said connecting means with its pivotal axis being substantially parallel to said plane containing said arcuate path;

said suspension means including a first rotatable member, having said pivot axis, rotatably mounted at its ends to said connecting means, and a second rotatable member pivotally secured to said first rotatable member with its rotation axis being substantially perpendicular to said pivot axis of said first rotatable member, said second rotatable member being operable for supporting said counter-balanced sheave assembly;

whereby said plane containing said arcuate path at all times approximately passes through and lies parallel with the cable positioned over said sheaves.

2. The counter-balanced sheave of claim 1, wherein said support frame defines an upwardly-facing trough having opposed sidewalls, each said sheave being rotatably mounted in traversing relationship between said sidewalls with said sidewalls extending above said sheaves, whereby said sidewalls guide and contain the cable.

3. The counter-balanced sheave of claim 2, wherein said counter-balance means comprises a pair of substantially equal weighted members mounted on opposite sides of said suspension means.

4. The counter-balanced sheave of claim 3, wherein said connecting means includes a pair of side frames extending downward to connect with said support frame to hold it rigidly in place relative to said connecting means.

5. The counter-balanced sheave of claim 4, wherein said first rotating member is rotatably mounted in traversing relationship between said side frames.

6. The counter-balanced sheave of claim 5, wherein said side frames each include an upwardly extending weight holder arm connected to one of said weight members.

7. A counter-balanced sheave assembly for supporting a downward extending cable having a tension applied thereto, comprising:

a support frame;

a plurality of sheaves rotatably mounted to said support frame along a downwardly facing arcuate path in a single plane;

counter-balancing means positioned above said support frame and rigidly interconnected with said support frame;

suspension means for pivotally mounting said assembly in the proximity of its balance center so that said assembly can rotate about two substantially perpendicular axis;

said suspension means including a first rotatable member, having said pivot axis, rotatably mounted at its ends to said connecting means, and a second rotatable member pivotally secured to said first rotatable member with its rotation axis being substantially perpendicular to said pivot axis of said first rotatable member, said second rotatable member being operable for supporting said counter-balanced sheave assembly;

whereby the plane of said arcuate path approximately passes through and lies parallel with the cable positioned over said sheaves.

8. The counter-balanced sheave assembly of claim 7, wherein the axes of rotation of said sheaves are substantially perpendicular to said plane of said arcuate path.

* * * * *